US010086847B2

(12) United States Patent
Ikemoto

(10) Patent No.: US 10,086,847 B2
(45) Date of Patent: Oct. 2, 2018

(54) INTERLOCK MECHANISM FOR VEHICLE CONTROL DEVICE

(71) Applicant: MITSUBISHI ELECTRIC CORPORATION, Chiyoda-ku, Tokyo (JP)

(72) Inventor: Minoru Ikemoto, Tokyo (JP)

(73) Assignee: MITSUBISHI ELECTRIC CORPORATION, Chiyoda-Ku (JP)

( * ) Notice: Subject to any disclaimer, the term of this patent is extended or adjusted under 35 U.S.C. 154(b) by 0 days.

(21) Appl. No.: 15/538,490

(22) PCT Filed: Dec. 22, 2014

(86) PCT No.: PCT/JP2014/083949

§ 371 (c)(1),
(2) Date: Jun. 21, 2017

(87) PCT Pub. No.: WO2016/103329

PCT Pub. Date: Jun. 30, 2016

(65) Prior Publication Data

US 2017/0350164 A1 Dec. 7, 2017

(51) Int. Cl.

| | |
|---|---|
| ***B61C 17/00*** | (2006.01) |
| ***E05B 65/00*** | (2006.01) |
| ***E05B 11/02*** | (2006.01) |
| ***E05B 19/00*** | (2006.01) |
| ***B65D 25/04*** | (2006.01) |

(52) U.S. Cl.

CPC ..... *B61C 17/00* (2013.01); *B65D 25/04* (2013.01); *E05B 11/02* (2013.01); *E05B 19/0005* (2013.01); *E05B 65/006* (2013.01)

(58) Field of Classification Search

CPC ..... B61C 17/00; E05B 11/02; E05B 19/0005; E05B 65/006; B65D 25/04

See application file for complete search history.

(56) References Cited

FOREIGN PATENT DOCUMENTS

| | | | |
|---|---|---|---|
| JP | S59-210167 | A | 11/1984 |
| JP | S63-60378 | A | 3/1988 |
| JP | 2006-50802 | A | 2/2006 |
| JP | 2009-189159 | A | 8/2009 |
| JP | 2013-201834 | A | 10/2013 |

OTHER PUBLICATIONS

International Search Report (PCT/ISA/210) dated Feb. 10, 2015, by the Japanese Patent Office as the International Searching Authority for International Application No. PCT/J P2014/083949.

Written Opinion (PCT/ISA/237) dated Feb. 10, 2015, by the Japanese Patent Office as the International Searching Authority for International Application No. PCT/JP2014/083949.

*Primary Examiner* — Daniel Cavallari

(74) *Attorney, Agent, or Firm* — Buchanan Ingersoll & Rooney PC

(57) ABSTRACT

In an interlock system, locking of a second locking mechanism is enabled only when a first key holding part holds a first key and a control device is in a state in which a residual voltage of the control device is not discharged. Application of a power supply voltage to the control device is enabled by switching of a ground switch only when a second key holding part holds a second key. Removal of the second key from the second key holding part is enabled only when the ground switch is in the grounded position and the control device is in a grounded state. Removal of the first key from the first key holding part is enabled only when the control device is in a state in which residual voltage is discharged.

19 Claims, 13 Drawing Sheets

INTERLOCK MECHANISM FOR VEHICLE CONTROL DEVICE

TECHNICAL FIELD

The present disclosure relates to an interlock mechanism for a vehicle control device.

BACKGROUND ART

In an electric railway vehicle (referred to hereinafter as the "electric vehicle") that includes a high voltage device, control is performed to interlock between access to the interior of a high voltage device chamber and application of high voltage to the high voltage device.

The interlock device for hinged doors disclosed in Patent Literature 1 includes a cylinder lock mechanism for which inserting and removing of a key are enabled only while rotated to a locking position, and performs interlock control between operation of the cylinder lock mechanism and operation of another device, by combined use of a lock with another device. This interlock device for hinged doors enables application of voltage to the high voltage device only after completion of locking of all the locks of the doors of a high voltage device chamber.

In the interlock lock box disclosed in Patent Literature 2, removing of a plurality of sub-keys is enabled only after insertion and operation of a master key, and the master key can be removed only after insertion and operation of all of the plurality of sub-keys.

CITATION LIST

Patent Literature

Patent Literature 1: Unexamined Japanese Patent Application Kokai Publication No. S63-60378

Patent Literature 2: Unexamined Japanese Patent Application Kokai Publication No. S59-210167

SUMMARY OF INVENTION

Technical Problem

By use of the technologies disclosed in Patent Literature 1 and Patent Literature 2, interlock control can be performed between application of high voltage to a high voltage device chamber and opening and closing of a door of the high voltage device chamber. However, when maintenance is performed on the high voltage device in the high voltage device chamber, a maintenance person is required to discharge the high voltage device after opening the door of the high voltage device chamber. Thus there is a possibility that the maintenance person will carelessly touch the high voltage device prior to the discharging of the high voltage device.

The present disclosure is developed in consideration of the aforementioned circumstances, and an objective of the present disclosure is to improve safety of the vehicle control device.

Solution to Problem

In order to achieve the aforementioned objective, an interlock mechanism for a vehicle control device of the present disclosure includes a first locking mechanism, a first key holding part, a second locking mechanism, and a second key holding part. The first locking mechanism enables operation on a control device for a vehicle when the first locking mechanism is unlocked. Removal of the key of the first locking mechanism is enabled only when the first locking mechanism is locked. The first key holding part holds the first key, which is the key of the first locking mechanism. Unlocking of the second locking mechanism enables operation of the first key holding part and operation of a discharge switch that causes discharge of a residual voltage of the control device when the discharge switch is closed. Removal of the key of the second locking mechanism is enabled only when the second locking mechanism is locked. The second key holding part holds the second key, which is the key of the second locking mechanism, and controls permitting of operation of a ground switch switching between a ungrounded state, in which power voltage is applied to the control device, and a grounded state in which the control device is connected to ground and is disconnected from the power source. Opening of the discharge switch is enabled only when the first locking mechanism is locked and the first key holding part holds the first key. Locking of the second locking mechanism is enabled only when the discharge switch is open. Switching of the ground switch and setting of the control device to the ungrounded state are enabled only when the second locking mechanism is locked and the second key holding part holds the second key. Removing of the second key from the second holding part is enabled only when the control device is in the grounded state, and removing of the first key from the first key holding part is enabled only when the second locking mechanism is unlocked and the discharge switch is closed.

Advantageous Effects of Invention

According to the present disclosure, safety of the vehicle control device can be improved by performing interlock control between the operation of the locking mechanism and the operation of the discharge switch.

DESCRIPTION OF EMBODIMENTS

Figure 1:
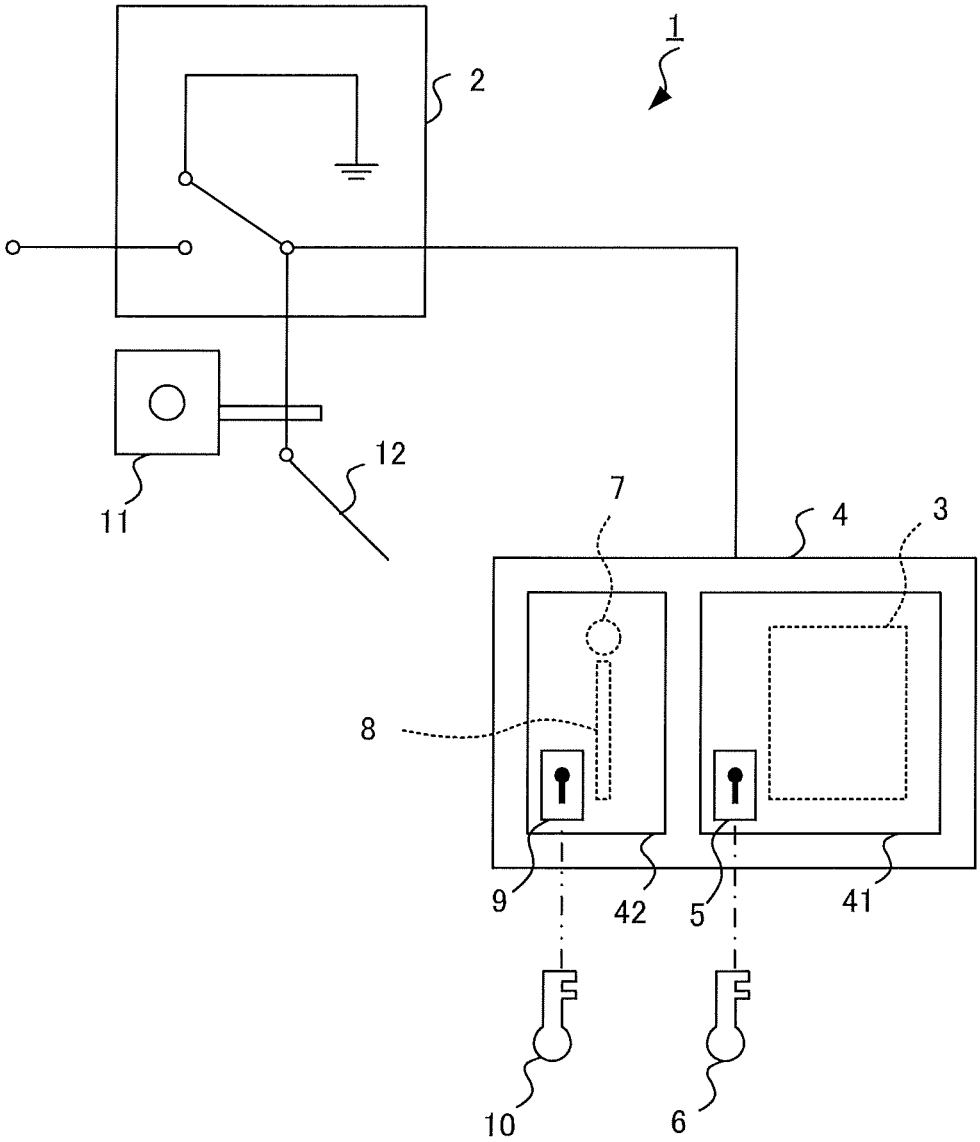
FIG. 1 is a drawing illustrating an example configuration of an interlock system according to Embodiment 1 of the present disclosure.

Embodiments of the present description are described below in detail in reference to drawings. Further, in the drawings, components that are the same or equivalent are assigned the same reference signs.

Embodiment 1

FIG. 1 is a drawing illustrating an example configuration of an interlock system according to Embodiment 1 of the present disclosure. An interlock system 1 including an interlock mechanism for a vehicle control device (referred to hereinafter as the "interlock mechanism") performs control of interlocking between operation of a locking mechanism and an operation of discharging residual voltage of the vehicle control device. This interlock control enables application of power supply voltage to the vehicle control device after locking of the locking mechanism in a normal state in which the vehicle control device is not discharged. Further, by performance of this interlock control, after grounding and discharging of the vehicle control device, unlocking of the locking mechanism is enabled, and operation on the vehicle control device is enabled.

The interlock system 1 includes the interlock mechanism, a ground switch 2, a control device 3 including a discharge switch 8, and a switch operation member 12 that performs switching of the ground switch 2. The interlock mechanism includes: a first locking mechanism 5 that, when unlocked, enables operation on the control device 3, a first key holding part 7 that holds a first key 6 for the first locking mechanism 5, a second locking mechanism 9 that, when unlocked, enables operation of the first key holding part 7 and the discharge switch 8, and a second key holding part 11 that holds a second key 10 for the second locking mechanism 9 and controls enablement of operation of the ground switch 2.

The ground switch 2 switches between an ungrounded state, in which the control device 3 is connected to a non-illustrated power supply and the power supply voltage is applied to the control device 3, and a grounded state in which the control device 3 is grounded and isolated from the power supply. When the ground switch 2 is in the grounded position, the control device 3 is in the grounded state; and when the ground switch 2 is in the ungrounded position, the control device 3 is in the ungrounded state. The switching of the ground switch 2 is performed by operation of the switch operation member 12.

The control device 3 is a control device for a vehicle and drives a main electric motor by converting and outputting an applied voltage. The control device 3 is contained in a housing 4. The housing 4 has a below-described first opening and a first opening cover 41 that opens and closes the first opening. Due to the providing of the first opening, a maintenance person, for example, can perform an operation on the control device 3. The first locking mechanism 5 locks and unlocks the first opening cover 41. When the first locking mechanism 5 is unlocked and the first opening cover 41 is opened, operation on the control device 3 is enabled. The first locking mechanism 5 has a conventional locking mechanism, such as that mentioned in Patent Literature 1, which enables locking only when the first opening cover 41 is closed, and enables removing of the first key 6 only when the locking mechanism is locked.

The first key holding part 7 holds the first key 6. The expression "first key holding part 7 that holds a first key 6" refers to a state in which the first key 6 is fixed in the first key holding part 7 so that the key does not fall out due to, for example, vibration during travel of the vehicle. For example, the first key holding part 7 includes a rotation mechanism that is positioned either at an unlocked position, in which inserting and removing of the key are enabled, or a locked position in which inserting and removing of the key are not enabled. The rotation mechanism is a cylinder lock mechanism, for example.

When the discharge switch 8 is closed, the discharge switch 8 allows discharging of residual voltage of the control device 3. By closing of the discharge switch 8 to discharge the residual voltage of components such as a capacitor included in the control device 3, maintenance of the control device 3 can be safely performed.

The first key holding part 7 and the discharge switch 8 are contained in the housing 4. The housing 4 includes a below-described second opening and a second opening cover 42 that opens and closes the second opening. Due to providing of the second opening, the maintenance person, for example, can operate the first key holding part 7 and the discharge switch 8. The second locking mechanism 9, which is a locking mechanism that is separate from the first locking mechanism 5, performs locking and unlocking of the second opening cover 42. When the second locking mechanism 9 is unlocked and then the second opening cover 42 is opened, operation of the first key holding part 7 and the discharge switch 8 is enabled. The second locking mechanism 9 has a conventional locking mechanism, such as that mentioned in Patent Literature 1, for which locking is enabled only when the second opening cover 42 is closed, and removing of the second key 10 is enabled only when the locking mechanism is locked. Structures of the first locking mechanism 5 and the second locking mechanism 9 may be the same or different.

The second key holding part 11 holds the second key 10. The second key holding part 11 controls enablement of operation of the switch operation member 12. The second key holding part 11 has a conventional key box mechanism such as that described in Patent Literature 1, for example. Setting of the control device 3 to the ungrounded state by switching of the ground switch 2 to the ungrounded position by operation of the switch operation member 12 is enabled only when the key box mechanism of the second key holding part 11 is connected to the mechanism of the switch operation member 12 and the second key holding part 11 holds the second key 10. Further, the second key 10 can be removed from the second key holding part 11 only when the control device 3 is set to the grounded state by switching of the ground switch to the grounded position by operation of the switch operation member 12.

Figure 2:
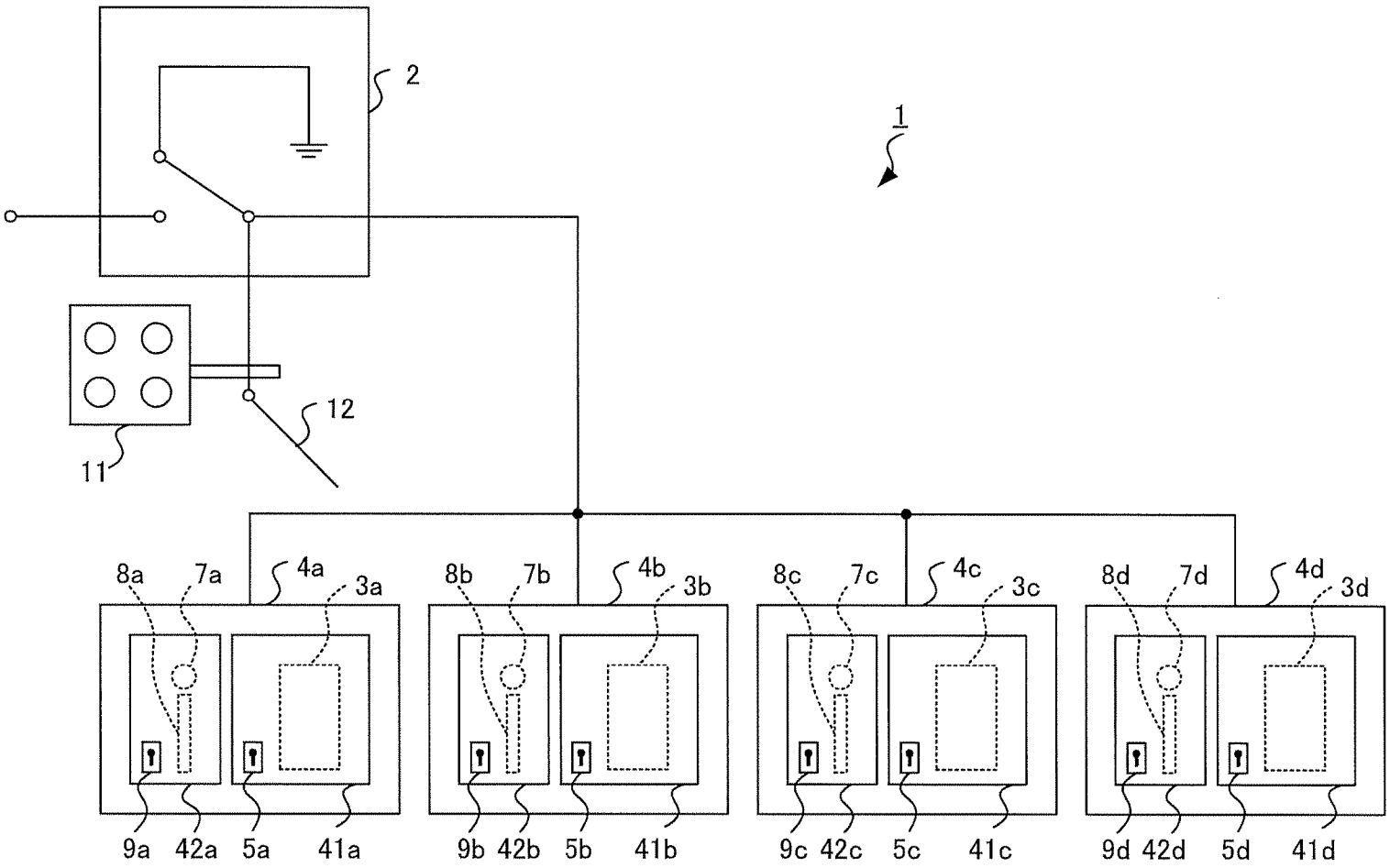
FIG. 2 is a drawing illustrating another example configuration of the interlock system according to Embodiment 1.

The interlock system 1 can include a freely-selected number of the control devices 3. FIG. 2 is a drawing illustrating another example configuration of the interlock system according to Embodiment 1. The interlock system 1 of FIG. 2 includes control devices 3*a*, 3*b*, 3*c*, and 3*d*, and performs control of interlocking between the operation of the locking mechanism and the discharge operation of the control devices 3*a*, 3*b*, 3*c*, and 3*d*. Configuration and operation of each of the components of the interlock system 1 of FIG. 2 are the same as the configuration and operation of the each of components of the interlock system 1 of FIG. 1. The second key holding part 11 holds the second keys 10 for the second locking mechanisms 9*a*, 9*b*, 9*c*, and 9*d*. Switching of the ground switch 2 to the ungrounded position by operation of the switch operation member 12 is enabled only when the second key holding part 11 holds all of the second keys 10.

Figure 3:
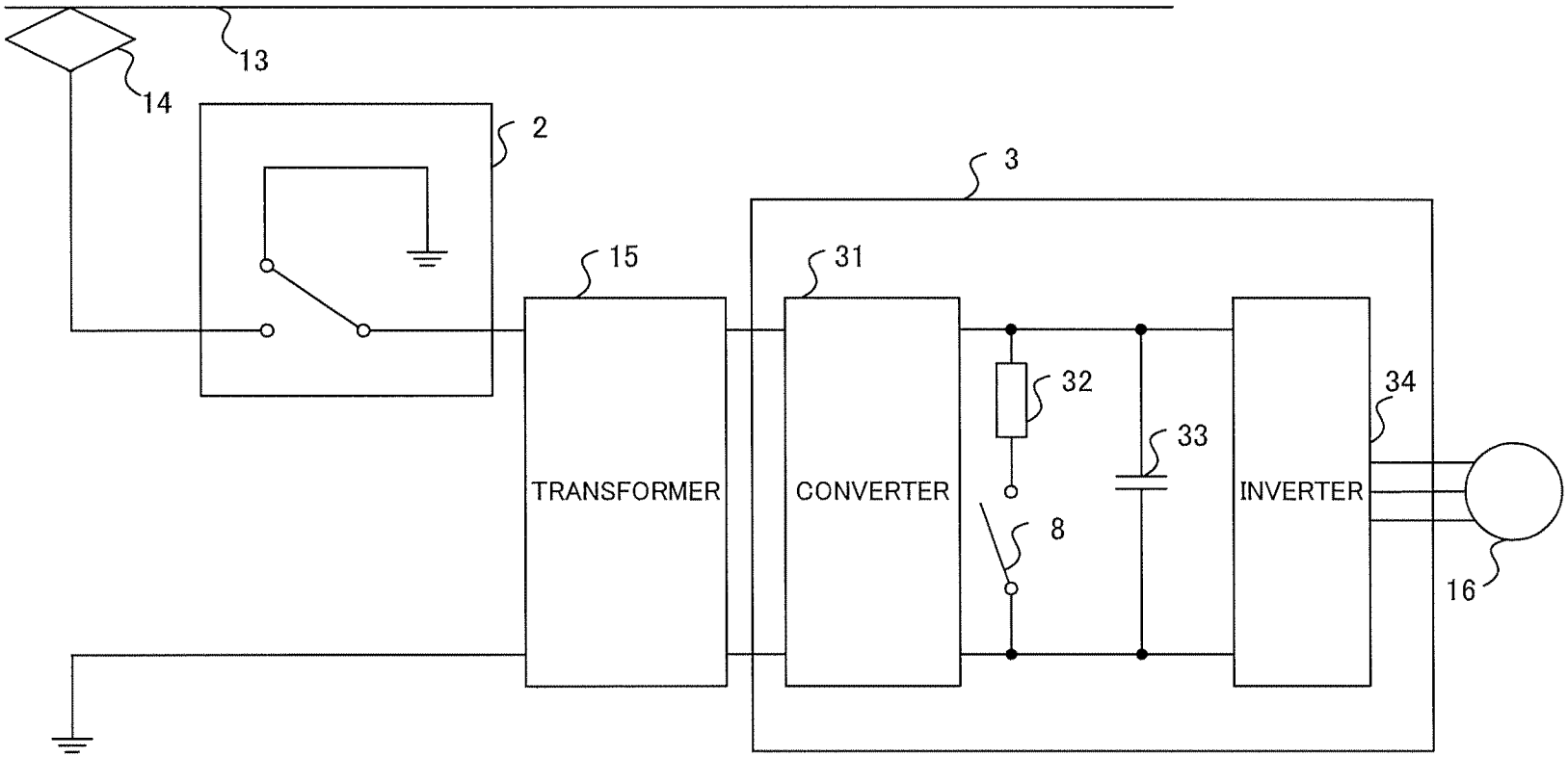
FIG. 3 is a circuit diagram illustrating an example of mounting a control device according to Embodiment 1 in an electric railway vehicle.

FIG. 3 is a circuit diagram illustrating an example of mounting the control device according to Embodiment 1 in the electric railway vehicle. Voltage obtained from the overhead line 13 by the power collector 14 such as a pantograph is applied via the ground switch 2 to a transformer 15. The transformer 15 steps down the applied voltage and outputs the stepped-down voltage to the control device 3. The control device 3 includes a converter 31 that converts alternating current voltage to direct current voltage, a discharging resistance 32, the discharge switch 8, a capacitor 33, and an inverter 34 that converts the direct current voltage to alternating current three-phase voltage. The inverter 34 drives a main electric motor 16. Residual voltage occurs in the capacitor 33 when the control device 3 is set to the grounded state by switching of the ground switch 2 to the grounded position. Discharging of the residual voltage of the capacitor 33 is enabled by closing of the discharge switch 8.

Figure 4:
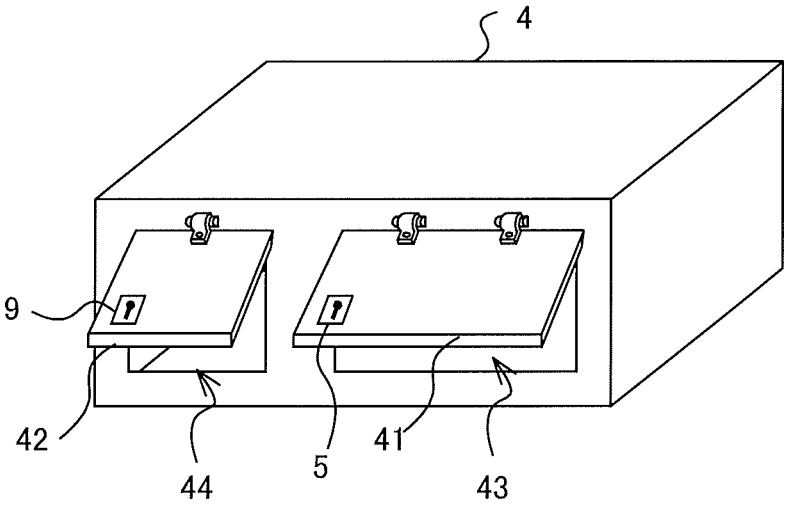
FIG. 4 is a perspective view of a housing to contain the control device according to Embodiment 1.

FIG. 4 is a perspective view of the housing to contain the control device according to Embodiment 1. The housing 4 includes a first opening 43, a first opening cover 41 that opens and closes the first opening 43, a second opening 44, and a second opening cover 42 that opens and closes the second opening 44. The housing 4 is equipped with the first locking mechanism 5 and the second locking mechanism 9. The shape of the housing 4 is not limited to the example illustrated in FIG. 4. A partition may be arranged in the interior of the housing 4 between the control device 3, and the first key holding part 7 and the discharge switch 8. The providing of the partition enables increased safety of the maintenance person. The control device 3 may be contained in a first housing, and the first key holding part 7 and the discharge switch 8 may be contained in a second housing. Containing of the control device 3 and the discharge switch 8 in different housings enables increased safety of the maintenance person.

Figure 5:
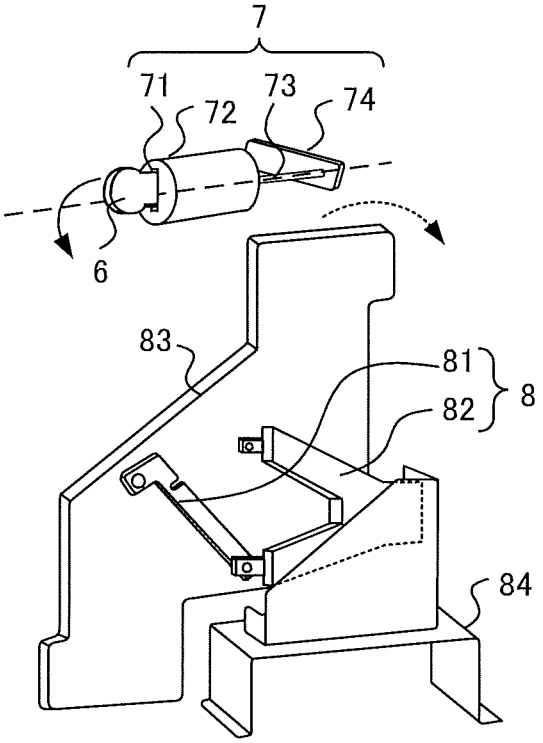
FIG. 5 is a perspective view of a first key holding part and a discharge switch according to Embodiment 1.

FIG. 5 is a perspective view of the first key holding part and the discharge switch according to Embodiment 1. The first key holding part 7 includes a rotation mechanism 72 that has an insertion hole 71, and a latch 74 that is connected to the rotation mechanism 72 via a rotation shaft 73. The rotation mechanism 72 rotates around the direction of insertion of the first key 6 between the unlocked position in which inserting and removing of the first key 6 are enabled, and the locked position in which the first key 6 is held. The rotation mechanism 72 rotates, for example, when the maintenance person inserts the first key 6 in the insertion hole 71 and then turns the first key 6 in the counterclockwise direction. In the example of FIG. 5, the rotation mechanism 72 is in the locked position, and rotation centered around the direction, indicated by the dashed line, of insertion of the first key 6 is enabled in the counterclockwise direction toward the unlocked position as indicated by the solid-line arrow. The latch 74 connected to the rotation mechanism 72 rotates in conjunction with rotating of the rotation mechanism 72. The latch 74 is rectangle-shaped, for example. In the example of FIG. 5, when the rotation mechanism 72 is in the locked position, the latch 74 is positioned parallel to a bottom surface of the housing 4, and in conjunction with rotating of the rotation mechanism 72 toward the unlocked position, the latch 74 also rotates in the counterclockwise direction.

The discharge switch 8 includes a movable member 81 and a fixed member 82, and the movable member 81 is connected to an operation member 83. Further, the discharge switch 8 is fixed by a mounting fixture 84 to the housing 4. The operation member 83 switches the discharge switch 8 by being positioned at either a normal position in which the discharge switch 8 is open, or a discharge position in which the discharge switch 8 is closed. For example, the discharge switch 8 is switched by the maintenance person operating the operation member 83. In the example of FIG. 5, the operation member 83 is in the normal position. The movable member 81 is moved in the clockwise direction toward the discharge position as indicated by the dashed-line arrow.

Figure 6:
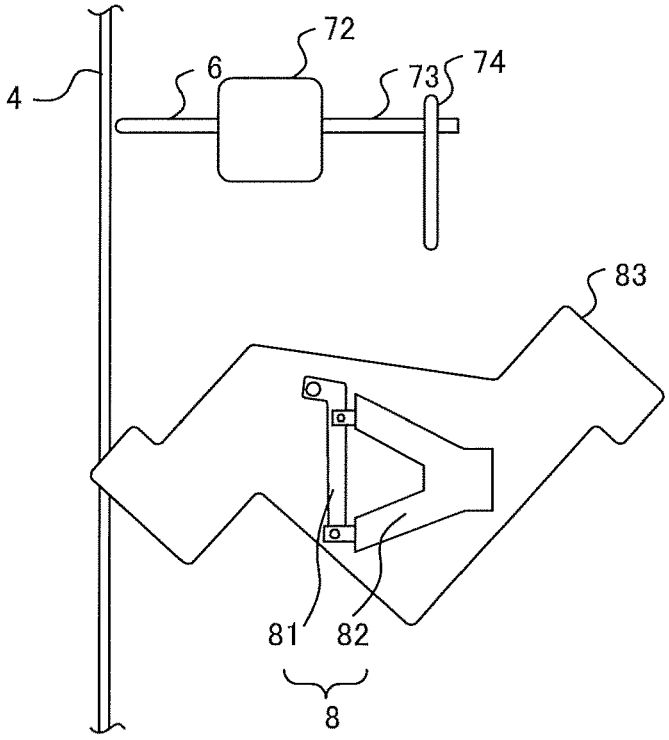
FIG. 6 is a side view illustrating a state in which a rotation mechanism according to Embodiment 1 is in an unlocked position and an operation member is in a discharge position.
Figure 7:
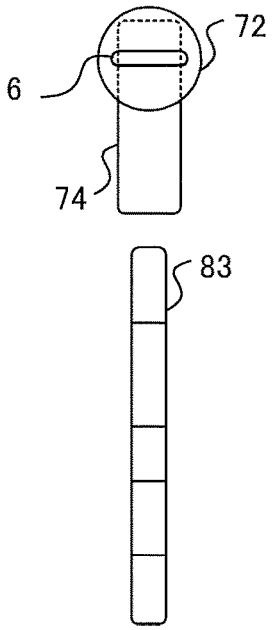
FIG. 7 is a front view illustrating the state in which the rotation mechanism according to Embodiment 1 is in the unlocked position and the operation member is in the discharge position.

The locking operation is described below, from the state in which operation on the control device 3 is enabled, to the application of the power supply voltage to the control device 3. FIG. 6 is a side view illustrating a state in which a rotation mechanism according to Embodiment 1 is in an unlocked position and an operation member is in a discharge position. FIG. 7 is a front view illustrating the state in which the rotation mechanism according to Embodiment 1 is in the unlocked position and the operation member is in the discharge position. FIG. 6 and FIG. 7 illustrate the first key holding part 7 and the operation member 83 when the first locking mechanism 5 is locked. After the maintenance person, for example, completes maintenance work, the maintenance person locks the first locking mechanism 5, removes the first key 6, and inserts the first key 6 in the insertion hole 71 of the first key holding part 7. As illustrated in FIG. 6, when the operation member 83 is in the discharge position, a portion of the operation member 83 protrudes to the exterior of the housing 4, and thus the second opening cover 42 cannot be closed, and the second locking mechanism 9 cannot be locked.

Figure 8:
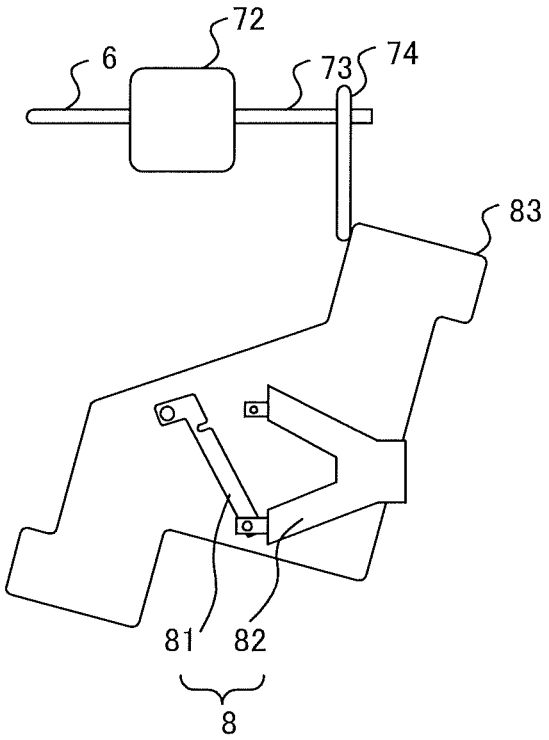
FIG. 8 is a side view illustrating a state in which the first key holding part and the operation member according to Embodiment 1 contact each other.
Figure 9:
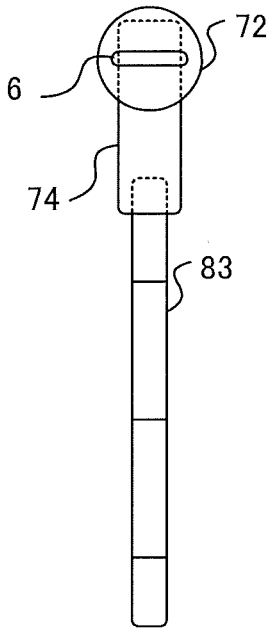
FIG. 9 is a front view illustrating the state in which the first key holding part and the operation member according to Embodiment 1 contact each other.

FIG. 8 is a side view illustrating a state in which the first key holding part and the operation member according to Embodiment 1 contact each other. FIG. 9 is a front view illustrating the state in which the first key holding part and the operation member according to Embodiment 1 contact each other. When the rotation mechanism 72 is in the unlocked position, as illustrated in FIG. 8 and FIG. 9, the latch 74 and the operation member 83 contact each other during moving of the operation member 83 from the discharge position to the normal position, and thus the operation member 83 is prevented from moving from the discharge position to the normal position. That is to say, when the rotation mechanism 72 is in the unlocked position, the operation member 83 cannot be moved to the normal position.

Figure 10:
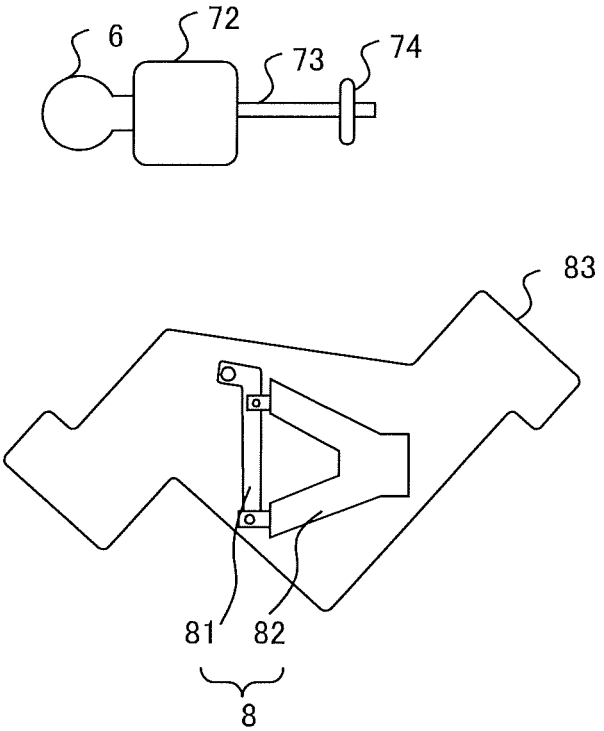
FIG. 10 is a side view illustrating a state in which the rotation mechanism according to Embodiment 1 is in the locked position and the operation member is in the discharge position.
Figure 11:
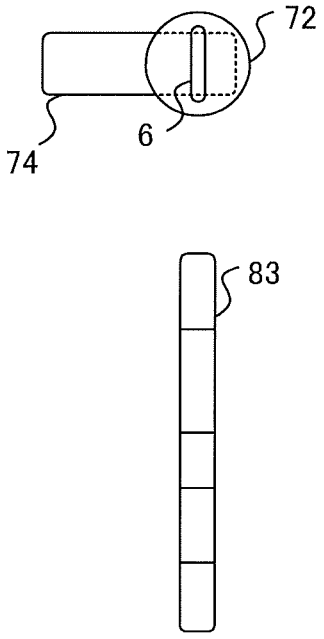
FIG. 11 is a front view illustrating the state in which the rotation mechanism according to Embodiment 1 is in the locked position and the operation member is in the discharge position.

FIG. 10 is a side view illustrating a state in which the rotation mechanism according to Embodiment 1 is in the locked position and the operation member is in the discharge position. FIG. 11 a front view illustrating the state in which the rotation mechanism according to Embodiment 1 is in the locked position and the operation member is in the discharge position. When the rotation mechanism 72 is in the locked position, the latch 74 and the operation member 83 do not contact each other, and moving of the operation member 83 from the discharge position to the normal position is enabled.

Figure 12:
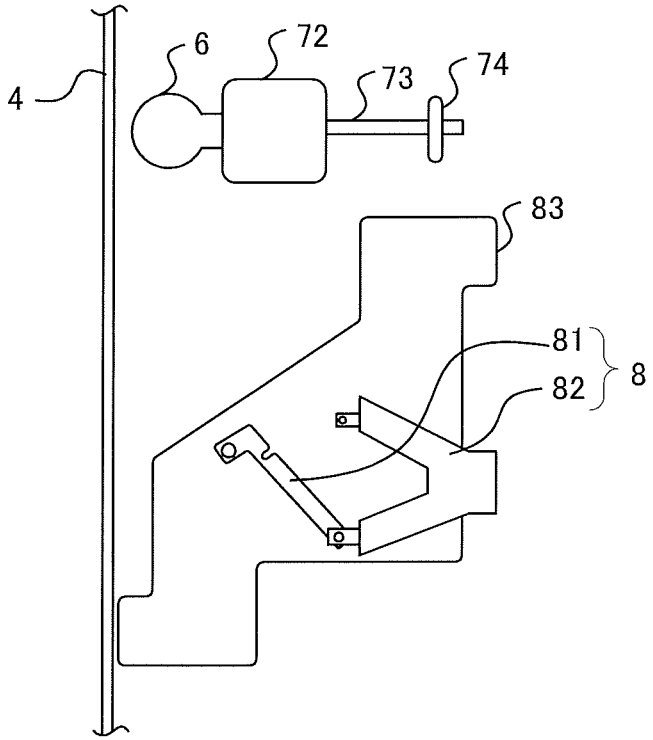
FIG. 12 is a side view illustrating a state in which the rotation mechanism according to Embodiment 1 is in the locked position and the operation member is in the normal position.
Figure 13:
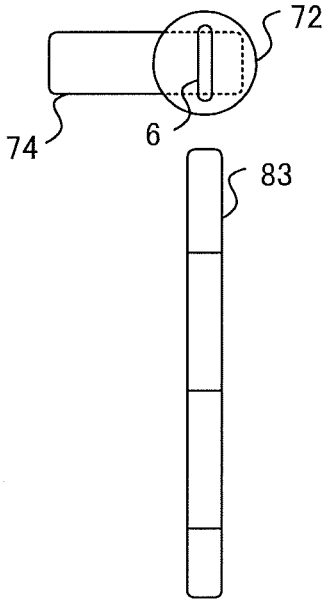
FIG. 13 is a front view illustrating the state in which the rotation mechanism according to Embodiment 1 is in the locked position and the operation member is in the normal position.

FIG. 12 is a side view illustrating a state in which the rotation mechanism according to Embodiment 1 is in the locked position and the operation member is in the normal position. FIG. 13 is a front view illustrating the state in which the rotation mechanism according to Embodiment 1 is in the locked position and the operation member is in the normal position. When the operation member 83 is moved from the discharge position to the normal position, the state illustrated in FIG. 10 and FIG. 11 transitions to the state illustrated in FIG. 12 and FIG. 13. As illustrated in FIG. 13, when the rotation member 72 is in the locked position and the operation member 83 is in the normal position, the second opening cover 42 can be closed.

When the second opening cover 42 is closed and the second locking mechanism 9 locked, removing of the second key 10 is enabled. As illustrated in FIG. 1, the key box mechanism of the second key holding part 11 and the switch operation member 12 mechanism are connected together. Thus setting of the control device 3 to the ungrounded state by switching of the ground switch 2 to the ungrounded position by operation of the switch operation member 12 is enabled only when the second key 10 is inserted in the second key holding part 11 and the second key holding part 11 holds the second key 10. When the maintenance person, for example, locks the second locking mechanism 9, inserts the second key 10 into the second key holding part 11, operates the switch operation member 12, and thus sets the ground switch to the ungrounded position, the power supply voltage is applied to the control device 3.

In the interlock system 1, setting of the control device 3 to the state in which the control device 3 is not discharged is enabled by opening the discharge switch 8 by operation of the discharge switch 8 only when the first opening cover 41 is locked and the first key holding part 7 holds the first key 6. The second opening cover 42 can be locked only when the discharge switch 8 is opened. The ground switch 2 can be switched to the ungrounded position by operation of the switch operation member 12 only when the second key holding part 11 holds the second key 10. Application of the power supply voltage to the control device 3 is enabled only when the discharge switch 8 is opened and the first locking mechanism 5 and the second locking mechanism 9 are locked, and thus safety of the control device 3 can be improved.

The unlocking operation is described below from the ungrounded state in which the power supply voltage is applied to the control device 3, to the state in which operation on the control device 3 is enabled. When the ground switch 2 is switched to the grounded position to set the control device 3 to the grounded state, removing of the second key 10 from the second key holding part 11 is enabled. The second opening cover 42 is unlocked by the second key 10. At the point in time when the second opening cover 42 is unlocked, as illustrated in FIG. 12 and FIG. 13, the rotation mechanism 72 is in the locked position, and the operation member 83 is in the normal position.

Figure 14:
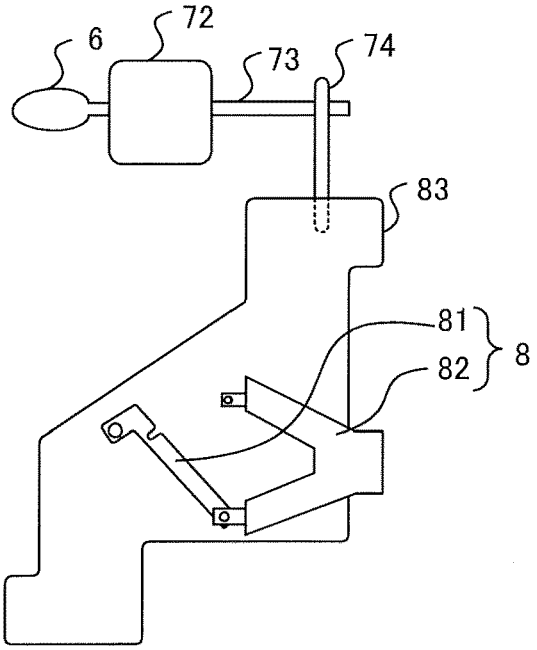
FIG. 14 is a side view illustrating a state in which the first key holding part and the operation member according to Embodiment 1 contact each other.
Figure 15:
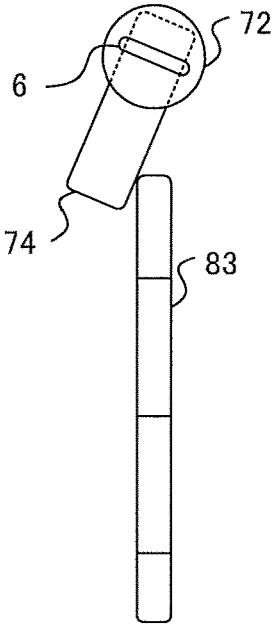
FIG. 15 is a front view illustrating the state in which the first key holding part and the operation member according to Embodiment 1 contact each other.

FIG. 14 is a side view illustrating a state in which the first key holding part and the operation member according to Embodiment 1 contact each other. FIG. 15 is a front view illustrating the state in which the first key holding part and the operation member according to Embodiment 1 contact each other. When the operation member 83 is in the normal position, as illustrated in FIG. 14 and FIG. 15, the latch 74 and the operation member 83 contact each other during the rotating of the rotation mechanism 72 from the locked position to the unlocked position, and thus rotating of the rotation mechanism 72 from the locked position to the unlocked position is prevented. That is to say, when the operation member 83 is in the normal position, the rotation mechanism 72 is unable to be rotated from the locked position to the unlocked position.

As illustrated in FIG. 10 and FIG. 11, when the operation member 83 is in the discharge position, the rotation mechanism 72 can be rotated from the locked position to the unlocked position without contact between the latch 74 and the operation member 83. As illustrated in FIG. 6 and FIG. 7, removing of the first key 6 is enabled when the rotation mechanism 72 is in the unlocked position.

In the interlock system 1 as described above, removing of the second key 10 from the second key holding part 11 is enabled only when the control device 3 is in the grounded state. Removal of the first key 6 from the first key holding part 7 is enabled only when the discharge switch 8 is closed. Operation on the control device 3 is enabled only when the control device 3 is in the grounded state and the discharge switch 8 is closed, and thus safety of the control device 3 can be improved.

As described above, in the interlock mechanism of Embodiment 1, safety of the control device 3 can be improved by performing interlock control between the first locking mechanism 5 operation and the second locking mechanism 9 operation, and the operation of discharging the residual voltage of the control device 3.

Embodiment 2

Figure 16:
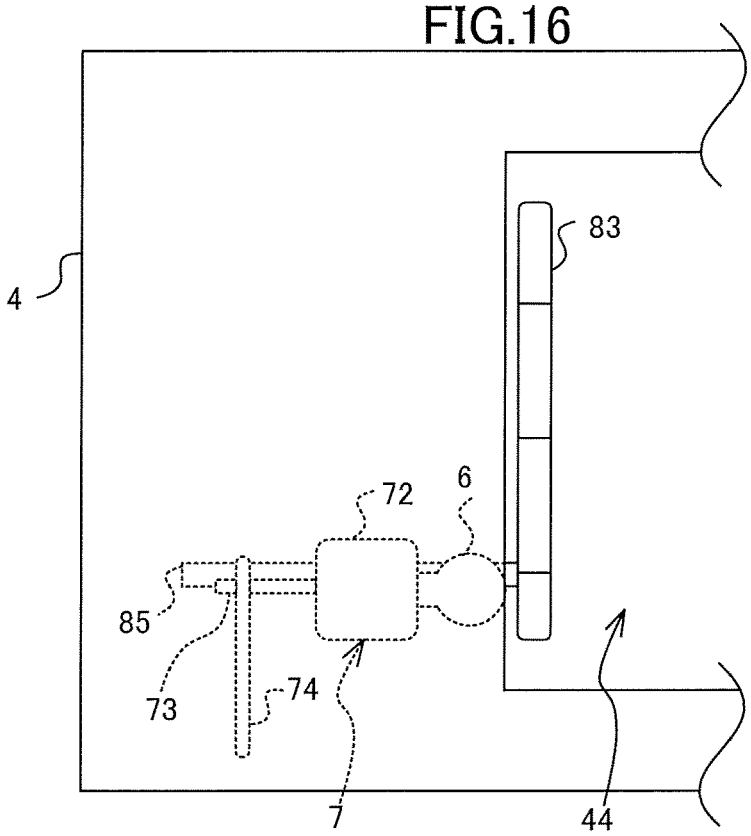
FIG. 16 is a partial front view of a housing according to Embodiment 2 of the present disclosure.

FIG. 16 is a partial front view of the housing according to Embodiment 2 of the present disclosure. The second opening cover 42 is not illustrated in FIG. 16. Although the configuration of the interlock system 1 according to Embodiment 2 is similar to the configuration of the interlock system 1 according to Embodiment 1, there are differences relative to Embodiment 1 with respect to the positions of arrangement of the first key holding part 7 and the operation member 83 and the shape of the operation member 83 in Embodiment 2. In the interlock system 1 according to Embodiment 2, the operation member 83 is arranged within the housing 4 between the first key holding part 7 and the second opening 44, and the operation member 83 has a projection 85 in the surface facing the first key holding part 7.

Figure 17:
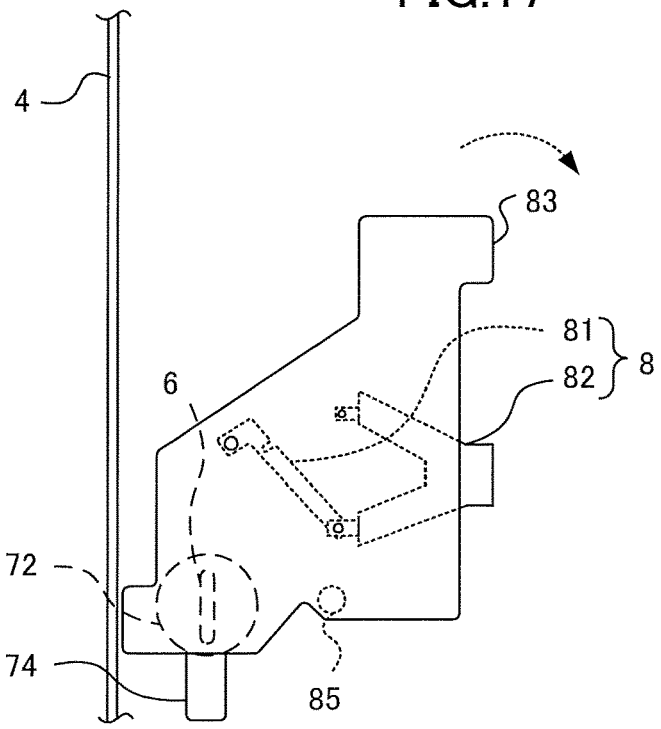
FIG. 17 is a side view illustrating a state in which a rotation mechanism according to Embodiment 2 is in the locked position and an operation member is in the normal position.

In FIG. 16, the rotation mechanism 72 is in the locked position, and the operation member 83 is in the normal position. FIG. 17 is a side view illustrating a state in which the rotation mechanism according to Embodiment 2 is in the locked position, and the operation member is in the normal position. The operation member 83 has a projection 85 in the surface facing the first key holding part 7. In the example of FIG. 16 and FIG. 17, when the rotation mechanism 72 is in the locked position, the latch 74 is positioned perpendicular to the bottom surface of the housing 4. When the operation member 83 is in the normal position, the surface where the insertion hole 71 of the first key holding part 7 is arranged is covered by the operation member 83, and the first key holding part 7 cannot be operated.

Figure 18:
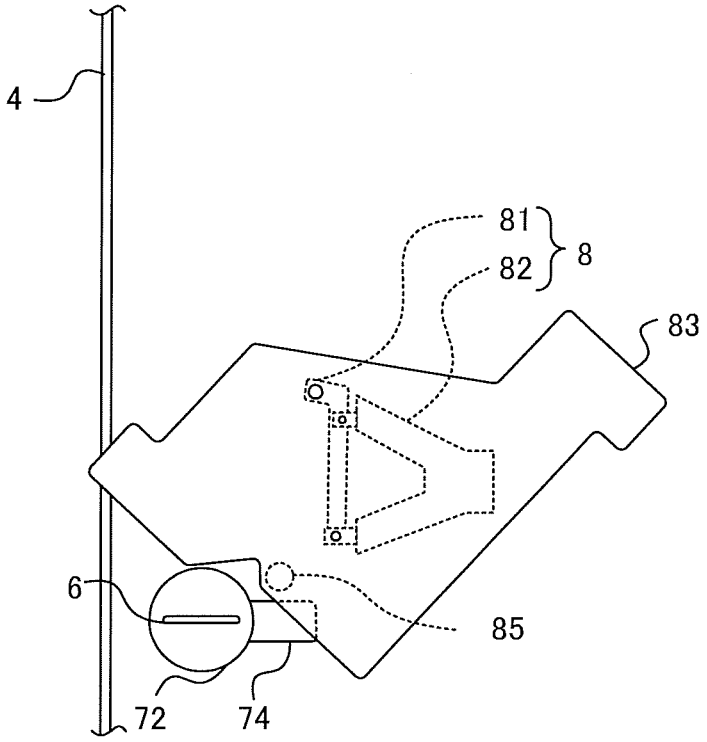
FIG. 18 is a side view illustrating a state in which the rotation mechanism according to Embodiment 2 is in the unlocked position and the operation member is in the discharge position.
Figure 19:
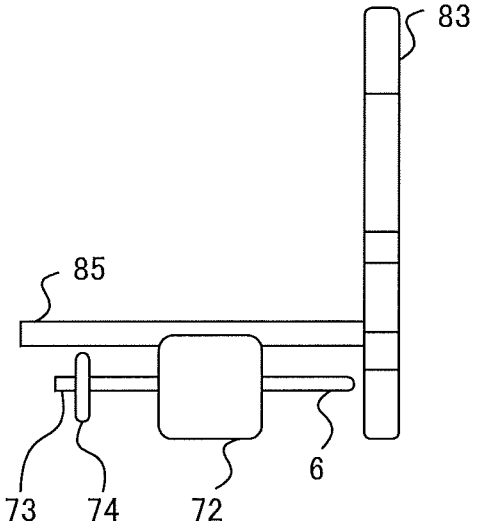
FIG. 19 is a front view illustrating a state in which the first key holding part according to Embodiment 2 is in the unlocked position and the operation member is in the discharge position.

The locking operation is described below from the state in which operation on the control device 3 is enabled, to the application of the power supply voltage to the control device 3. FIG. 18 is a side view illustrating a state in which the rotation mechanism according to Embodiment 2 is in the unlocked position and the operation member is in the discharge position. FIG. 19 is a front view illustrating a state in which the first key holding part according to Embodiment 2 is in the unlocked position and the operation member is in the discharge position. FIG. 18 and FIG. 19 illustrate the first key holding part 7 and the operation member 83 with the first locking mechanism 5 locked. For example, after the maintenance person completes the maintenance work, the maintenance person locks the first locking mechanism 5, removes the first key 6, and inserts the first key 6 in the insertion hole 71 of the first key holding part 7. In the same manner as Embodiment 1, when the operation member 83 is in the discharge position, a portion of the operation member 83 projects to the exterior of the housing 4, and thus the second opening cover 42 cannot be closed, and the second locking mechanism 9 cannot be locked.

Figure 20:
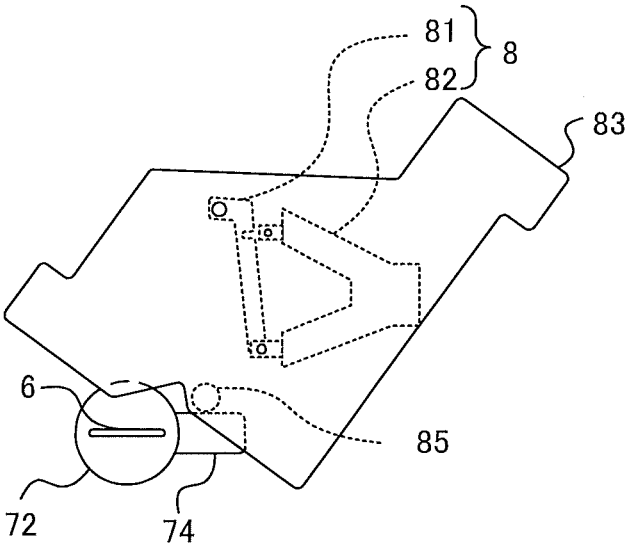
FIG. 20 is a side view illustrating a state in which the first key holding part and the operation member according to Embodiment 2 contact each other.
Figure 21:
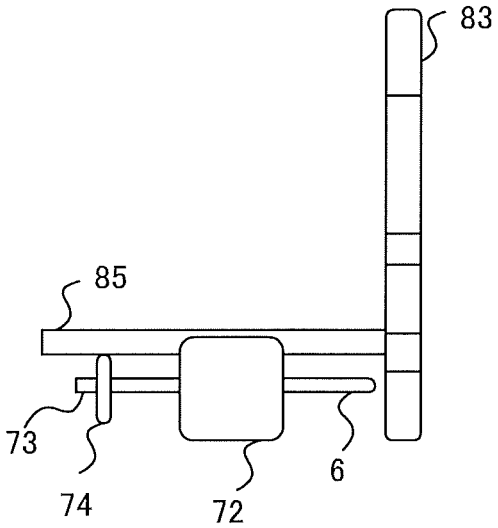
FIG. 21 is a front view illustrating the state in which the first key holding part and the operation member according to Embodiment 2 contact each other.

FIG. 20 is a side view illustrating a state in which the first key holding part and the operation member according to Embodiment 2 contact each other. FIG. 21 is a front view illustrating the state in which the first key holding part and the operation member according to Embodiment 2 contact each other. When the rotation mechanism 72 is in the unlocked position, as illustrated in FIG. 20 and FIG. 21, the latch 74 and the projection 85 contact each other during the moving of the operation member 83 from the discharge position to the normal position, and thus the moving of the operation member 83 from the discharge position to the normal position is prevented. That is to say, when the rotation mechanism 72 is in the unlocked position, the operation member 83 cannot be moved to the normal position.

Figure 22:
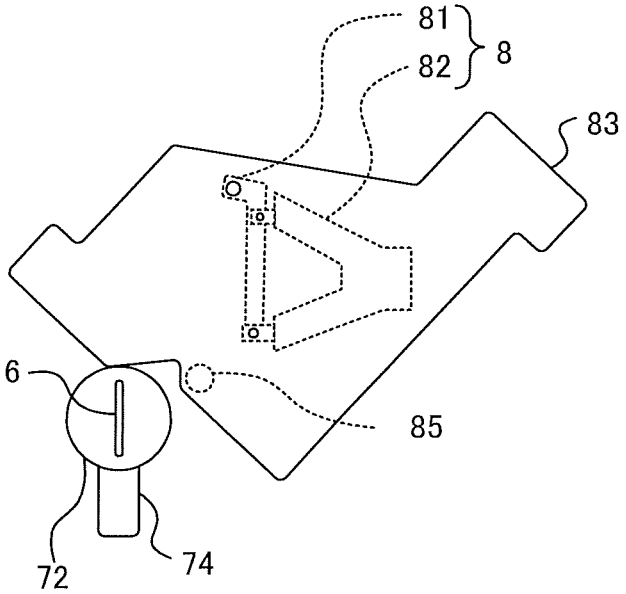
FIG. 22 is a side view illustrating a state in which the rotation mechanism according to Embodiment 2 is in the locked position and the operation member is in the discharge position.
Figure 23:
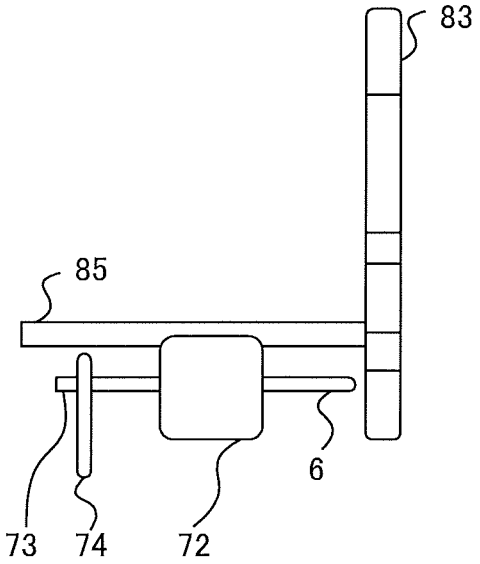
FIG. 23 is a front view illustrating a state in which the rotation mechanism according to Embodiment 2 is in the locked position and the operation member is in the discharge position.

FIG. 22 is a side view illustrating a state in which the rotation mechanism according to Embodiment 2 is in the locked position and the operation member is in the discharge position. FIG. 23 is a front view illustrating a state in which the rotation mechanism according to Embodiment 2 is in the locked position and the operation member is in the discharge position. When the rotation mechanism 72 is in the locked position, moving of the operation member 83 from the discharge position to the normal position is enabled without contact between the latch 74 and the projection 85. When the operation member 83 is moved from the discharge position to the normal position, the state illustrated in FIG. 22 and FIG. 23 transitions to the state illustrated in FIG. 16 and FIG. 17. As illustrated in FIG. 17, when the rotation mechanism 72 is in the locked position and the operation member 83 is in the normal position, the second opening cover 42 can be closed.

Processing thereafter is the same as that of Embodiment 1. In the aforementioned manner, in the interlock system 1, setting of the control device 3 to the state in which the control device 3 is not discharged is enabled by opening the discharge switch 8 by operation of the discharge switch 8 only when the first opening cover 41 is locked and the first key holding part 7 holds the first key 6. The second opening cover 42 can be locked only when the discharge switch 8 is opened. The ground switch 2 can be switched to the ungrounded position by operation of the switch operation member 12 only when the second key holding part 11 holds the second key 10. Application of the power supply voltage to the control device 3 is enabled only when the discharge switch 8 is opened and the first locking mechanism 5 and the second locking mechanism 9 are locked, and thus safety of the control device 3 can be improved.

The unlocking operation from the ungrounded state, in which the power supply voltage is applied to the control device 3, to the state in which operation on the control device 3 is enabled is described below. When the ground switch 2 is switched to the grounded position to set the control device 3 to the grounded state, the second key 10 can be removed from the second key holding part 11. The second opening cover 42 is unlocked with the second key 10. At the point in time when the second opening cover 42 is unlocked, as illustrated in FIG. 17, the rotation mechanism 72 is in the locked position, and the operation member 83 is in the normal position. When the operation member 83 is in the normal position, the surface in which the insertion hole 71 of the first key holding part 7 is arranged is covered by the operation member 83, and the first key holding part 7 cannot be operated.

As illustrated in FIG. 22 and FIG. 23, when the operation member 83 is in the discharge position, operation of the first key holding part 7 is enabled, and the rotation mechanism 72 can be rotated from the locked position to the unlocked position. As illustrated in FIG. 18 and FIG. 19, removing of the first key 6 is enabled when the rotation mechanism 72 is in the unlocked position.

In the aforementioned manner, in the interlock system 1, the second key 10 can be removed from the second key holding part 11 only when the control device 3 is in the grounded state. The first key 6 can be removed from the first key holding part 7 only when the discharge switch 8 is closed. Operation on the control device 3 is enabled only when the control device 3 is in the grounded state and the discharge switch 8 is closed, and thus safety of the control device 3 can be improved.

As described above, in the interlock mechanism of Embodiment 2, safety of the control device 3 can be improved by performing interlock control between the first locking mechanism 5 operation and the second locking mechanism 9 operation, and the operation of discharging residual voltage of the control device 3. The first key holding part 7 cannot be operated when the discharge switch 8 is open, and thus safety of the control device 3 can be further improved.

The embodiments of the present disclosure are not limited to the aforementioned embodiments. For example, the rotation mechanism 72 may include a member that protrudes in response to rotating of the rotation mechanism 72 from the locked position to the unlocked position. When the operation member 83 is in the normal position and the rotation mechanism 72 is rotated from the locked position to the unlocked position, this member protrudes during rotation and contacts the operation member 83. Due to contact between this member and the operation member 83, rotating of the rotation member 72 from the locked position to the unlocked position is prevented.

Further, the shape of the latch 74, the shape of the operation member 83, and the shape of the projection 85 are each freely selected. The first key holding part 7 and the operation member 83 can also be arranged in any positions. For example, the first key holding part 7 may be arranged so that the second opening 44 faces the insertion hole 71, and the operation member 83 may be arranged between the first key holding part 7 and the second opening 44.

The control device 3 may be arranged in the high voltage device chamber rather than in the housing 4, and the first locking mechanism 5 may perform the locking and unlocking of the door of the high voltage device chamber. The control device 3 is not limited to being the control device of the electric vehicle, and may be the control device of an electric automobile and the like. The control device 3 may be contained in the housing 4, and the first key holding part 7 and the discharge switch 8 may be arranged to the exterior of the housing 4. In this case, the first key holding part 7 and the discharge switch 8 may be configured, for example, so as to be capable of operation only when a key is inserted, and the first key holding part 7 and the discharge switch 8 can be operated only when the second locking mechanism 9 is unlocked.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

REFERENCE SIGNS LIST

1 Interlock system
2 Ground switch
3, 3*a*, 3*b*, 3*c*, 3*d* Control device
4, 4*a*, 4*b*, 4*c*, 4*d* Housing
5, 5*a*, 5*b*, 5*c*, 5*d* First locking mechanism
6 First key
7, 7*a*, 7*b*, 7*c*, 7*d* First key holding part
8, 8*a*, 8*b*, 8*c*, 8*d* Discharge switch
9, 9*a*, 9*b*, 9*c*, 9*d* Second locking mechanism
10 Second key
11 Second key holding part
12 Switch operation member
13 Overhead line
14 Power collector
15 Transformer
16 Electric motor
31 Converter
32 Discharging resistance
33 Capacitor
34 Inverter
41 First opening cover
42 Second opening cover
43 First opening
44 Second opening
71 Insertion hole
72 Rotation mechanism
73 Rotation shaft
74 Latch
81 Movable member
82 Fixed member
83 Operation member
84 Mounting fixture
85 Projection

The invention claimed is:

1. An interlock mechanism for a vehicle control device, comprising:

a first locking mechanism to enable operation on the vehicle control device when the first locking mechanism is unlocked, and to enable key removal only when the first locking mechanism is locked;

a first key holding part to hold a first key, the first key being a key of the first locking mechanism;

a second locking mechanism to enable, when the second locking mechanism is unlocked, operation of the first key holding part and a discharge switch for discharging of a residual voltage of the vehicle control device when the discharge switch is closed, and to enable key removal only when the second locking mechanism is locked; and a second key holding part to hold a second key and to control enablement of operation of a ground switch switching between an ungrounded state in which a power supply voltage is applied to the vehicle control device and a grounded state in which the vehicle control device is isolated from the power supply and grounded, the second key being a key of the second locking mechanism, wherein opening of the discharge switch is enabled only when the first locking mechanism is locked and the first key holding part holds the first key, locking of the second locking mechanism is enabled only when the discharge switch is open, switching of the ground switch to set the vehicle control device to the ungrounded state is enabled only when the second locking mechanism is locked and the second key holding part holds the second key, removing of the second key from the second key holding part is enabled only when the vehicle control device is in the grounded state, and removing of the first key from the first key holding part is enabled only when the second locking mechanism is unlocked and the discharge switch is closed.

2. The interlock mechanism for a vehicle control device according to claim 1, wherein the first locking mechanism locks and unlocks a first opening cover for opening and closing a first opening included in a housing containing the vehicle control device;

the second locking mechanism locks and unlocks a second opening cover for opening and closing a second opening included in the housing containing the first key holding part and the discharge switch;

the second key holding part is disposed outside the housing;

opening of the discharge switch is enabled only when the first opening cover is locked and the first key holding part holds the first key; and locking of the second opening cover is enabled only when the discharge switch is open, and switching of the ground switch to set the vehicle control device to the ungrounded state is enabled only when the second opening cover is locked and the second key holding part holds the second key.

3. The interlock mechanism for a vehicle control device according to claim 2, removing of the second key from the second key holding part is enabled only when the vehicle control device is in the grounded state, and removing of the first key from the first key holding part is enabled only when the second locking mechanism is unlocked and the discharge switch is closed.

4. The interlock mechanism for a vehicle control device according to claim 2, wherein the housing comprises a first enclosure having the first opening, and a second enclosure having a second opening, the vehicle control device is contained in the first enclosure, the first key holding part and the discharge switch are contained in the second enclosure, and the second key holding part is disposed outside the first enclosure and the second enclosure.

5. The interlock mechanism for a vehicle control device according to claim 3, wherein the housing comprises a first enclosure having the first opening, and a second enclosure having a second opening, the vehicle control device is contained in the first enclosure, the first key holding part and the discharge switch are contained in the second enclosure, and the second key holding part is disposed outside the first enclosure and the second enclosure.

6. The interlock mechanism for a vehicle control device according to claim 2, further comprising a partition disposed in an interior of the housing between (i) the vehicle control device and (ii) the first key holding part and the discharge switch.

7. The interlock mechanism for a vehicle control device according to claim 3, further comprising a partition disposed in an interior of the housing between (i) the vehicle control device and (ii) the first key holding part and the discharge switch.

8. The interlock mechanism for a vehicle control device according to claim 2, further comprising an operation member contained in the housing, to switch the discharge switch by being positioned at either a normal position in which the discharge switch is open, or a discharge position in which the discharge switch is closed, wherein the first key holding part further comprises:

a rotation mechanism to rotate, around an insertion direction of the first key, between an unlocked position in which inserting and removing of the first key is enabled and a locked position in which the first key is held, and a latch that is a member to rotate in conjunction with rotating of the rotation mechanism, or is a member to project in conjunction with rotating of the rotation mechanism from the locked position to the unlocked position, and when the rotation mechanism is in the unlocked position, moving of the operation member from the discharge position to the normal position is prevented by contact between the latch and the operation member, when the rotation mechanism is in the locked position, moving of the operation member from the discharge position to the normal position is enabled, when the operation member is in the normal position, rotating of the rotation mechanism from the locked position to the unlocked position is prevented by contact between the latch and the operation member, and when the operation member is in the discharge position, rotating of the rotation mechanism from the locked position to the unlocked position is enabled.

9. The interlock mechanism for a vehicle control device according to claim 3, further comprising an operation member contained in the housing, to switch the discharge switch by being positioned at either a normal position in which the discharge switch is open, or a discharge position in which the discharge switch is closed, wherein the first key holding part further comprises:

a rotation mechanism to rotate, around an insertion direction of the first key, between an unlocked position in which inserting and removing of the first key is enabled and a locked position in which the first key is held, and a latch that is a member to rotate in conjunction with rotating of the rotation mechanism, or is a member to project in conjunction with rotating of the rotation mechanism from the locked position to the unlocked position, and when the rotation mechanism is in the unlocked position, moving of the operation member from the discharge position to the normal position is prevented by contact between the latch and the operation member, when the rotation mechanism is in the locked position, moving of the operation member from the discharge position to the normal position is enabled, when the operation member is in the normal position, rotating of the rotation mechanism from the locked position to the unlocked position is prevented by contact between the latch and the operation member, and when the operation member is in the discharge position, rotating of the rotation mechanism from the locked position to the unlocked position is enabled.

10. The interlock mechanism for a vehicle control device according to claim 8, wherein the housing comprises a first enclosure having the first opening, and a second enclosure having a second opening, the vehicle control device is contained in the first enclosure, the first key holding part, the discharge switch, and the operation member are contained in the second enclosure, and the second key holding part is disposed outside the first enclosure and the second enclosure.

11. The interlock mechanism for a vehicle control device according to claim 9, wherein the housing comprises a first enclosure having the first opening, and a second enclosure having a second opening, the vehicle control device is contained in the first enclosure, the first key holding part, the discharge switch, and the operation member are contained in the second enclosure, and the second key holding part is disposed outside the first enclosure and the second enclosure.

12. The interlock mechanism for a vehicle control device according to claim 2, further comprising an operation member disposed within the housing between the first key holding part and the second opening, and comprising a projection on a surface facing the first key holding part, to switch the discharge switch by being positioned at either a normal position in which the discharge switch is open, or a discharge position in which the discharge switch is closed, wherein the first key holding part comprises:

a rotation mechanism to rotate, around an insertion direction of the first key, between an unlocked position in which inserting and removing of the first key is enabled and a locked position in which the first key is held, and a latch that is a member to rotate in conjunction with rotating of the rotation mechanism, or is a member to project in conjunction with rotating of the rotation mechanism from the locked position to the unlocked position, and wherein when the rotation mechanism is in the unlocked position, moving of the operation member from the discharge position to the normal position is prevented by contact between the latch and the projection, when the rotation mechanism is in the locked position, moving of the operation member from the discharge position to the normal position is enabled, when the operation member is in the normal position, operation of the first key holding part is prevented by the operation part, and when the operation member is in the discharge position, rotating of the rotation mechanism from the locked position to the unlocked position, by operation of the first key holding part, is enabled.

13. The interlock mechanism for a vehicle control device according to claim 3, further comprising an operation member disposed within the housing between the first key holding part and the second opening, and comprising a projection on a surface facing the first key holding part, to switch the discharge switch by being positioned at either a normal position in which the discharge switch is open, or a discharge position in which the discharge switch is closed, wherein the first key holding part comprises:

a rotation mechanism to rotate, around an insertion direction of the first key, between an unlocked position in which inserting and removing of the first key is enabled and a locked position in which the first key is held, and a latch that is a member to rotate in conjunction with rotating of the rotation mechanism, or is a member to project in conjunction with rotating of the rotation mechanism from the locked position to the unlocked position, and wherein when the rotation mechanism is in the unlocked position, moving of the operation member from the discharge position to the normal position is prevented by contact between the latch and the projection, when the rotation mechanism is in the locked position, moving of the operation member from the discharge position to the normal position is enabled, when the operation member is in the normal position, operation of the first key holding part is prevented by the operation part, and when the operation member is in the discharge position, rotating of the rotation mechanism from the locked position to the unlocked position, by operation of the first key holding part, is enabled.

14. The interlock mechanism for a vehicle control device according to claim 12, wherein the housing comprises a first enclosure having the first opening, and a second enclosure having a second opening, the vehicle control device is contained in the first enclosure, the first key holding part, the discharge switch, and the operation member are contained in the second enclosure, the operation member is disposed in the second enclosure between the first key holding part and the second opening, and the second key holding part is disposed outside the first enclosure and the second enclosure.

15. The interlock mechanism for a vehicle control device according to claim 13, wherein the housing comprises a first enclosure having the first opening, and a second enclosure having a second opening, the vehicle control device is contained in the first enclosure, the first key holding part, the discharge switch, and the operation member are contained in the second enclosure, the operation member is disposed in the second enclosure between the first key holding part and the second opening, and the second key holding part is disposed outside the first enclosure and the second enclosure.

16. The interlock mechanism for a vehicle control device according to claim 8, wherein closing of the second opening cover is prevented by contact between the operation member and the second opening cover when the operation member is in the discharge position, and closing of the second opening cover is enabled when the operation member is in the normal position.

17. The interlock mechanism for a vehicle control device according to claim 10, wherein closing of the second opening cover is prevented by contact between the operation member and the second opening cover when the operation member is in the discharge position, and closing of the second opening cover is enabled when the operation member is in the normal position.

18. The interlock mechanism for a vehicle control device according to claim 12, wherein closing of the second opening cover is prevented by contact between the operation member and the second opening cover when the operation member is in the discharge position, and closing of the second opening cover is enabled when the operation member is in the normal position.

19. The interlock mechanism for a vehicle control device according to claim 14, wherein closing of the second opening cover is prevented by contact between the operation member and the second opening cover when the operation member is in the discharge position, and closing of the second opening cover is enabled when the operation member is in the normal position.

* * * * *